US008737627B2

(12) United States Patent
Wu

(10) Patent No.: US 8,737,627 B2
(45) Date of Patent: May 27, 2014

(54) ELECTRONIC DEVICE AND DECODING METHOD OF AUDIO DATA THEREOF

(75) Inventor: Chun-Te Wu, Tu-Cheng (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 471 days.

(21) Appl. No.: 13/163,722

(22) Filed: Jun. 19, 2011

(65) Prior Publication Data

US 2012/0269352 A1 Oct. 25, 2012

(30) Foreign Application Priority Data

Apr. 19, 2011 (TW) ..... 100113445

(51) Int. Cl.
*H04R 5/00* (2006.01)

(52) U.S. Cl.
USPC ..... 381/22

(58) Field of Classification Search
CPC ..... G06F 21/16; G10L 19/018; H04R 5/00
USPC ..... 381/1, 2, 10, 12, 19–22, 17, 18, 27; 380/254; 700/94
See application file for complete search history.

(56) References Cited

U.S. PATENT DOCUMENTS

| | | | | |
|---|---|---|---|---|
| 5,155,770 | A * | 10/1992 | Maejima | 381/18 |
| 5,539,780 | A * | 7/1996 | Dutkiewicz | 375/340 |
| 6,055,415 | A * | 4/2000 | Suzuki | 455/69 |
| 6,252,963 | B1 * | 6/2001 | Rhoads | 380/54 |
| 6,968,564 | B1 * | 11/2005 | Srinivasan | 725/9 |
| 7,369,677 | B2 * | 5/2008 | Petrovic et al. | 382/100 |
| 7,532,740 | B2 * | 5/2009 | Levy | 382/100 |
| 7,756,281 | B2 * | 7/2010 | Goldstein et al. | 381/309 |
| 7,928,310 | B2 * | 4/2011 | Georges et al. | 84/645 |
| 7,933,416 | B2 * | 4/2011 | Kim et al. | 381/23 |
| 7,986,789 | B2 * | 7/2011 | Purnhagen et al. | 381/23 |
| 8,526,611 | B2 * | 9/2013 | Moskowitz et al. | 380/205 |
| 2004/0133842 | A1 * | 7/2004 | Oki | 714/794 |
| 2005/0234728 | A1 * | 10/2005 | Tachibana et al. | 704/273 |
| 2006/0239501 | A1 * | 10/2006 | Petrovic et al. | 382/100 |
| 2006/0239502 | A1 * | 10/2006 | Petrovic et al. | 382/100 |
| 2006/0239503 | A1 * | 10/2006 | Petrovic et al. | 382/100 |
| 2007/0002971 | A1 * | 1/2007 | Purnhagen et al. | 375/316 |
| 2007/0055500 | A1 * | 3/2007 | Bilobrov | 704/217 |
| 2007/0100483 | A1 * | 5/2007 | Kentish et al. | 700/94 |
| 2007/0258607 | A1 * | 11/2007 | Purnhagen et al. | 381/307 |
| 2007/0270988 | A1 * | 11/2007 | Goldstein et al. | 700/94 |
| 2008/0273707 | A1 * | 11/2008 | Kentish et al. | 381/56 |
| 2008/0275697 | A1 * | 11/2008 | Kentish et al. | 704/216 |
| 2008/0310673 | A1 * | 12/2008 | Petrovic et al. | 382/100 |
| 2009/0044072 | A1 * | 2/2009 | Oh et al. | 714/758 |
| 2009/0110201 | A1 * | 4/2009 | Kim et al. | 381/2 |
| 2009/0304198 | A1 * | 12/2009 | Herre et al. | 381/66 |

* cited by examiner

*Primary Examiner* — Vivian Chin
*Assistant Examiner* — Leonard M Giannone
(74) *Attorney, Agent, or Firm* — Novak Druce Connolly Bove + Quigg LLP

(57) ABSTRACT

A decoding method of audio data is applied to an electronic device. The method includes: calculating difference values of the left and right channel audio signal values; determining time slots, wherein each of the first difference values exceeds a threshold value and a time length of the time slots exceeds a preset time; respectively multiplying the time slots with the left channel audio signal values and the right channel audio signal values to obtains and then making subtraction to obtain $DM_{1\sim n}$; finding a U shaped pattern or an inverse U shaped pattern which meets proportionality from the waveform of $DM_{1\sim n}$; and decoding the written symbol "0" or "1" according to the found U shaped pattern or inverse U shaped pattern.

15 Claims, 3 Drawing Sheets

(1)

(2)

(3)

ELECTRONIC DEVICE AND DECODING METHOD OF AUDIO DATA THEREOF

CROSS-REFERENCE TO RELATED APPLICATIONS

Related subject matter is disclosed in a copending application entitled, "ELECTRONIC DEVICE AND COPYRIGHT PROTECTION METHOD OF AUDIO DATA THEREOF", filed on Apr. 6, 2011 (application Ser. No. 13/080,669), and assigned to the same assignee as named herein.

BACKGROUND

1. Technical Field

The present disclosure relates to security of multimedia information, and more particularly, to an electronic device with a function of decoding audio data and a decoding method of audio data thereof.

2. Description of Related Art

In the copending application as identified above (application Ser. No. 13/080,669), a copyright protection method of audio data is disclosed for being applied to an electronic device. Left and right channel audio signal values are retrieved from audio signals of an audio source. Enveloping difference values between each left channel audio signal and each right channel audio signal are calculated to determine a time slot. The left channel audio signals and the right channel audio signals respectively modulated, thereby writing digital copyright information in corresponding positions of the time slot according to the modulation.

However, no method of decoding the digital copyright information from the modulated left channel audio signals and the modulated right channel audio signals is provided.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

Embodiments of the present disclosure will now be described in detail below, with reference to the accompanying drawings.

An embodiment of the copyright information protection method of audio data is already provided in the copending application. The digital copyright information is inserted in left and right channel audio signals when detecting a difference between the enveloping values of audio signals in a left channel and that in a right channel. The present disclosure discloses decoding the digital copyright information from the left and right channel audio signals.

Figure 1:
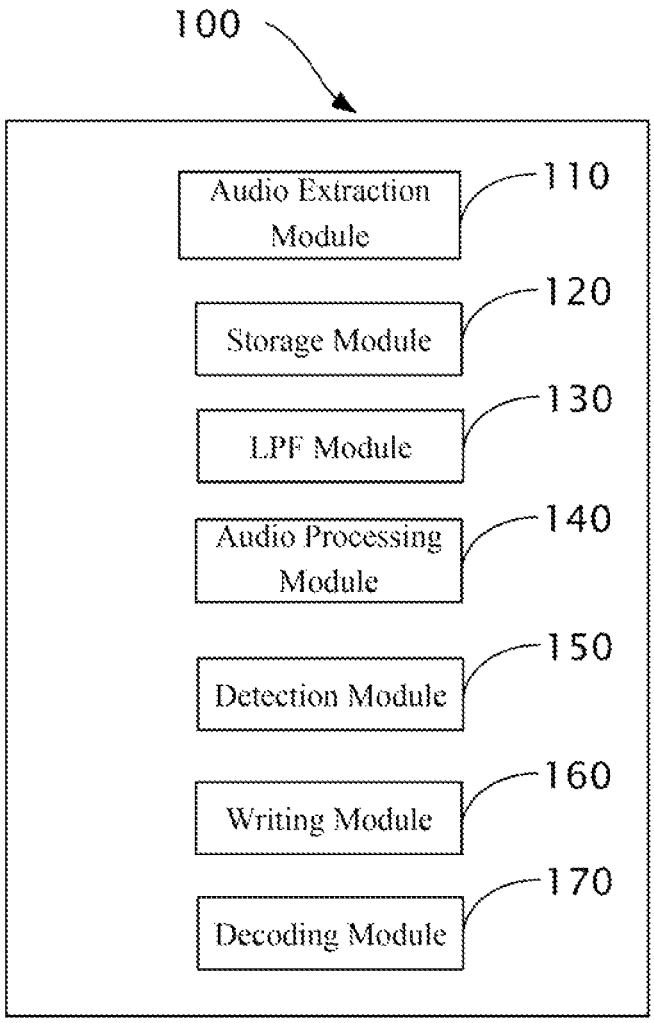
FIG. 1 is a block diagram of one embodiment of an electronic device in accordance with the present disclosure.

FIG. 1 is a block diagram of one embodiment of an electronic device 100 in accordance with the present disclosure.

The electronic device 100 may be a set-top box (STB) and the digital copyright information may be a serial number of the electronic device 100 or a unique serial number of the set-top box, for example. In an embodiment, the digital copyright information (e.g., the serial number) is a binary number including a number of bits, each bit of the binary number representing a symbol, each of the same time length.

In an embodiment, the electronic device 100 includes an audio extraction module 110, a storage module 120, a low pass filter (LPF) module 130, an audio processing module 140, a detection module 150, a writing module 160, and a decoding module 170.

The modules 110, 130, 140, 150, 160 and 170 may include computerized code in the form of one or more programs that are stored in the storage module 120. The computerized code includes instructions that are executed by the at least one processor (not shown) of the electronic device 100 to provide functions for the modules 110, 120, 130, 140, 150, 160 and 170.

In a process of inserting the digital copyright information in left and right channel audio signals, the audio extraction module 110 extracts left channel audio signal values $LAS_{1-n}$ in a left channel and right channel audio signal values $RAS_{1-n}$, in a right channel from audio signals $AS_{1-n}$ of a stereo audio source of an the electronic device 100. The audio extraction module 110 then performs a mathematical operation on the left channel audio signal values $LAS_{1-n}$ and the right channel audio signal values $RAS_{1-n}$ to generate absolute values thereof. The storage module 120 stores the left channel audio signal values $LAS_{1-n}$ and the right channel audio signal values $RAS_{1-n}$ retrieved by the audio extraction module 110. The LPF module 130 filters the left channel audio signal values $LAS_{1-n}$ and the right channel audio signal values $RAS_{1-n}$ to remove noise signals. The audio processing module 140 calculates enveloping values $LE_{1-n}$ for each left channel audio signal value $LAS_n$ and enveloping values $RE_{1-n}$ for each right channel audio signal value $RAS_n$ using a moving average method (MAM) and calculates absolute values of difference values between each left channel audio signal value $LAS_n$ and each right channel audio signal value $RAS_n$ (e.g., $ED_n$=ABS ($RE_n$−$LE_n$)). The difference values of left channel audio signal values $LAS_{1-n}$ and the right channel audio signal values $RAS_{1-n}$, can be represented by an enveloping difference curve. The detection module 150 detects time slots (e.g., $TS_a$, $TS_b$, . . . ) which are formed by audio signal values corresponding to enveloping difference values (e.g., $ED_{a1-an}$, $ED_{b1-bn}$, . . . ) according to the enveloping difference curve. Each of the enveloping difference values exceeds a threshold value and a time length of each time slot exceeds a preset time. The writing module 160 converts the digital copyright information stored in the storage module 120 to a binary number and writes the binary number in corresponding positions of one time slot involved in the enveloping curve.

In a process of decoding the digital copyright information in left and right channel audio signals, the audio extraction module 110 extracts left channel audio signal values $LBQ_{1-n}$ in a left channel and right channel audio signal values $RBQ_{1-n}$ in a right channel from audio signals $BQ_{1-n}$ of a stereo audio source of an the electronic device 100. The audio extraction module 110 then performs a mathematical operation on the left channel audio signal values $LBQ_{1-n}$ and the right channel audio signal values $RBQ_{1-n}$ to generate absolute values thereof.

The storage module 120 stores the left channel audio signal values $LBQ_{1-n}$ and the right channel audio signal values $RBQ_{1-n}$ retrieved by the audio extraction module 110.

The LPF module 130 filters the left channel audio signal values $LBQ_{1-n}$ and the right channel audio signal values $RBQ_{1-n}$ to remove noise signals.

The audio processing module 140 calculates enveloping values $LE_{1-n}'$ for each left channel audio signal value $LBQ_{1-n}$ and enveloping values $RE_{1-n}'$ for each right channel audio signal value $RBQ_{1\sim n}$ using the moving average method (MAM) and calculates absolute values of difference values between each left channel audio signal value $LE_{1-n}'$ and each right channel audio signal value $RE_{1-n}'$ (e.g., $ED_n'=BBS(RE_n'-LE_n')$). The difference values of left channel audio signal values $LBQ_{1-n}$ and the right channel audio signal values $RBQ_{1-n}$, can be represented by the enveloping difference curve.

The detection module 150 detects time slots (e.g., $TS_a'$, $TS_b'$, . . . ) which are formed by audio signal values corresponding to enveloping difference values (e.g., $ED_{a1-an}'$, $ED_{b1-bn}'$, . . . ) according to the enveloping difference curve. Each of the enveloping difference values exceeds the threshold value and the time length of each time slot exceeds the preset time.

The decoding module 170 respectively multiplies the time slots with the left channel audio signal values $LBQ_{1-n}$ and the right channel audio signal values $RBQ_{1-n}$ to obtain $LM_{1\sim n}$ and $RM_{1\sim n}$, and then makes subtraction to obtain $DM_{1\sim n}$ ($DM_{1\sim n}=LM_{1\sim n}-RM_{1\sim n}$).

In the process of inserting the digital copyright information in left and right channel audio signals, take one time slot for example, if a current symbol to be written is "0", the writing module 160 modulates a waveform, formed by five continuous left channel audio signal values, as an inverse U shaped pattern and modulates a waveform formed by five continuous right channel audio signal values, as a U shaped pattern, and then writes the symbol "0" in a signal position corresponding to the five continuous left channel audio signal values in the first time slot $TS_1$. Therefore, if the digital copyright information is inserted in the left and right channel audio signals, the waveform of $DM_{1\sim n}$ according to the time slot should be the U shaped pattern or the inverse U shaped pattern according to the written symbol "0" or "1".

The decoding module 170 finds U shaped pattern or the inverse U shaped pattern which meets proportionality from the waveform of $DM_{1\sim n}$, and then decodes the written symbol is "0" or "1" according to the found U shaped pattern or inverse U shaped pattern. Thereby, the binary number of the digital copyright information is decoded.

Figure 2:
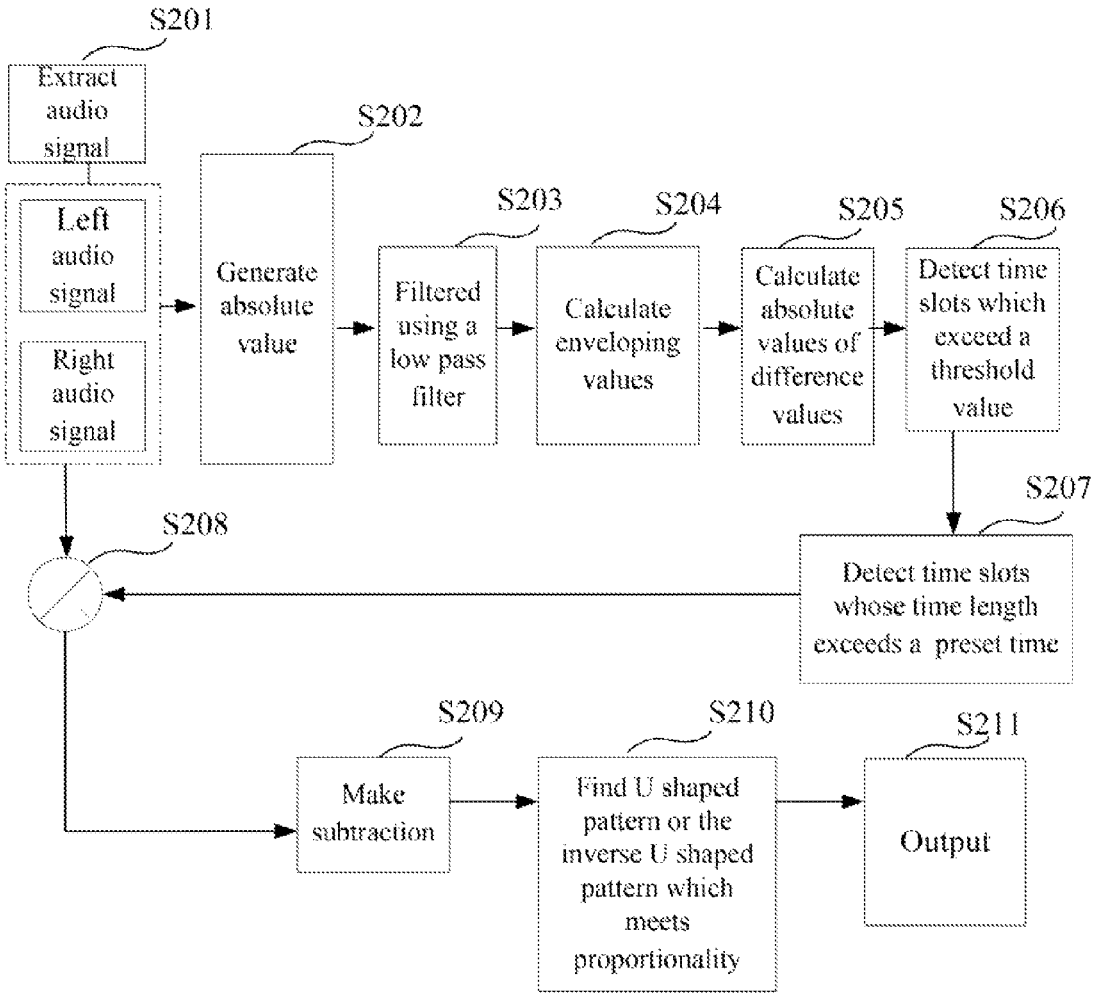
FIG. 2 is a flowchart of one embodiment of an encoding method of audio data in accordance with the present disclosure.

FIG. 2 is a flowchart of one embodiment of a decoding method of audio data in accordance with the present disclosure.

In step S201, the audio extraction module 110 extracts left channel audio signal values $LBQ_{1-n}$ in a left channel and right channel audio signal values $RBQ_{1-n}$ in a right channel from audio signals $BQ_{1-n}$ of a stereo audio source of an the electronic device 100.

In step S202, the audio extraction module 110 then performs a mathematical operation on the left channel audio signal values $LBQ_{1-n}$ and the right channel audio signal values $RBQ_{1-n}$ to generate absolute values thereof.

In step S203, the left channel audio signal values $LBQ_{1-n}$ and the right channel audio signal values $RBQ_{1-n}$ are respectively filtered using a low pass filter to remove noise signals.

In step S204, the audio processing module 140 calculates enveloping values $LE_{1-n}'$ for each left channel audio signal value $LBQ_{1-n}$ and enveloping values $RE_{1-n}'$ for each right channel audio signal value $RBQ_{1\sim n}$ using the moving average method (MAM).

In step S205, the audio processing module 140 calculates absolute values of difference values between each left channel audio signal value $LE_{1-n}'$ and each right channel audio signal value $RE_{1-n}'$ (e.g., $ED_n'=BBS(RE_n'-LE_n')$).

In step S206, the detection module 150 detects time slots (e.g., $TS_a'$, $TS_b'$, . . . ) which are formed by audio signal values corresponding to enveloping difference values (e.g., $ED_{a1-an}'$, $ED_{b1-bn}'$, . . . ) according to the enveloping difference curve and which exceed the threshold value.

In step S207, the detection module 150 detects the time slots whose time length exceeds the preset time.

In step S208, the decoding module 170 respectively multiplies the time slots with the left channel audio signal values $LBQ_{1-n}$ and the right channel audio signal values $RBQ_{1-n}$, obtains $LM_{1\sim n}$ and $RM_{1\sim n}$.

In step S209, the decoding module 170 makes subtraction to obtain $DM_{1\sim n}$ ($DM_{1\sim n}=LM_{1\sim n}-RM_{1\sim n}$).

In step S210, the decoding module 170 finds U shaped pattern or the inverse U shaped pattern which meets proportionality from the waveform of $DM_{1\sim n}$, and then decodes the written symbol is "0" or "1" according to the found U shaped pattern or inverse U shaped pattern.

In step S211, the decoding module 170 decodes the binary number of the digital copyright information which is inserted in the left and right channel audio signals, and thereby obtains the digital copyright information.

Figure 3:
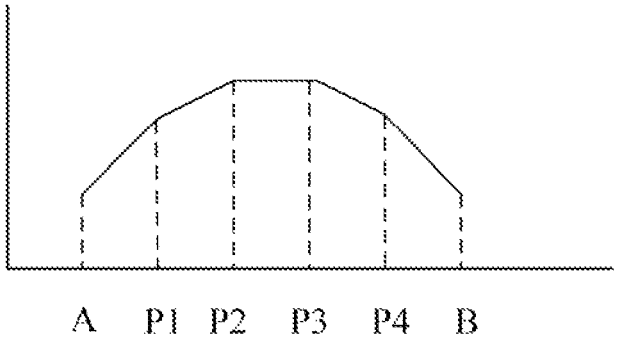
FIG. 3 is an exemplary view of one embodiment of three waveforms of U shaped pattern which meet proportionality in accordance with the present disclosure.
Figure 3:
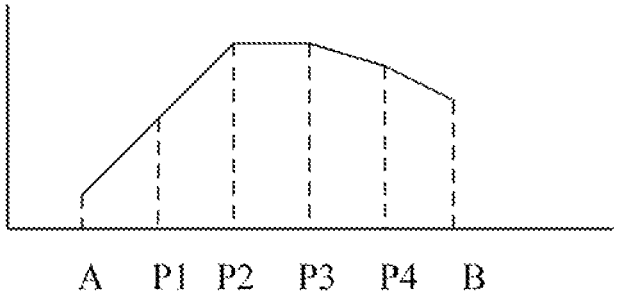
Figure 3:
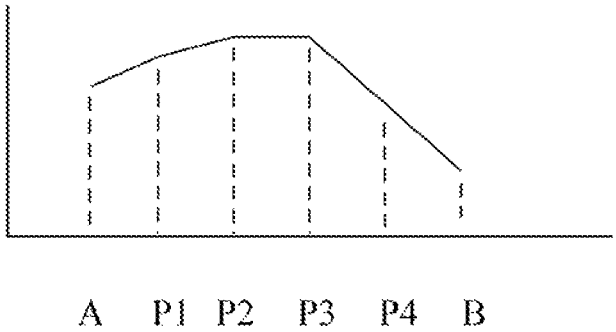

FIG. 3 is an exemplary view of one embodiment of three kinds of waveforms of the U shaped patterns, which meet proportionality in accordance with the present disclosure.

The method of determining whether the waveforms of U shaped patterns meet proportionality may be collecting audio signal values of the waveforms of the five continuous time slots, and determining if the audio signal values meet certain features of the three kinds of waveforms of the U shaped pattern. In the following, A, P1, P2, P3, P4, and B are used to represent the audio signal values of the waveforms of the five continuous time slots. In the first kind of waveform, the audio signal values meet a first feature: A=B, P1=(A+B)/2+I1, P2=(A+B)/2+I2, P3=P2=(A+B)/2+I2, P4=P2=(A+B)/2+I1; in the second kind of waveform, the audio signal values meet a second feature: A<B, P1=(A+B)/2−I1, P2=B+I2, P3=P2=B+I2, P4=B+I1; and in the third kind of waveform, the audio signal values meet a third feature: A>B, P1=A+I1, P2=A+I2, P3=P2=A+I2, P4=P2=(A+B)/2+I1, therein, I1 and I2 represent positive values which could be determined according to a specific waveform.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

What is claimed is:

1. A decoding method of audio data of an electronic device, the method comprising:

extracting left channel audio signal values in a left channel and right channel audio signal values in a right channel from audio signals of a stereo audio source of an the electronic device;

respectively filtering the left channel audio signal values and the right channel audio signal values to remove noise signals;

performing a mathematical operation on the left channel audio signal values and the right channel audio signal values to generate absolute values;

calculating difference values of the left and right channel audio signal values;

determining time slots which are formed by a plurality of first audio signal values corresponding to a plurality of first difference values among the difference values, wherein each of the first difference values exceeds a threshold value and a time length of the time slot exceeds a preset time;

respectively multiplying the time slots with the left channel audio signal values and the right channel audio signal values to obtain $LM_{1\sim n}$ and $RM_{1\sim n}$, wherein $LM_{1\sim n}$ represents a left channel audio signal value multiplied by the time slots and $RM_{1\sim n}$ represents a right channel audio signal value multiplied by the time slots, and then making subtraction to obtain $DM_{1\sim n}$($DM_{1\sim n}=LM_{1\sim n}-RM_{1\sim n}$);

finding a U shaped pattern or an inverse U shaped pattern which meets proportionality from the waveform of $DM_{1\sim n}$; and decoding the written symbol "0" or "1" according to the found U shaped pattern or inverse U shaped pattern.

2. The decoding method of audio data as claimed in claim 1, wherein the step of calculating the difference values of the left and right channel audio signal values further comprises:

calculating a plurality of first enveloping values for each of the left channel audio signal values;

calculating a plurality of second enveloping values for each of the right channel audio signal values; and calculating a plurality of enveloping difference values corresponding to the audio signal values on the basis of the first and second enveloping values.

3. The decoding method of audio data as claimed in claim 2, further comprising calculating the first and second enveloping values using a moving average method.

4. The decoding method of audio data as claimed in claim 1, wherein the digital copyright information is a binary number including a plurality of bits, each representing a symbol, wherein the step of finding a U shaped pattern or an inverse U shaped pattern which meets proportionality from the waveform of $DM_{1\sim n}$ further comprises:

a method of determining whether the waveforms of U shaped pattern meets proportionality may be collecting audio signal values of the waveforms of five continuous time slots, and determining if the audio signal values meet certain features of kinds of waveforms of the U shaped pattern.

5. The decoding method of audio data as claimed in claim 4, wherein A, P1, P2, P3, P4, and B are used to represent the audio signal values of the waveforms of the five continuous time slots, in a first kind of waveform, the audio signal values meet a first feature: A=B, P1=(A+B)/2+I1, P2=(A+B)/2+I2, P3=P2=(A+B)/2+I2, P4=P2=(A+B)/2+I1, therein, I1 and I2 represent positive values which could be determined according to a specific waveform.

6. The decoding method of audio data as claimed in claim 4, wherein A, P1, P2, P3, P4, and B are used to represent the audio signal values of the waveforms of the five continuous time slots, in a second kind of waveform, the audio signal values meet a first feature: A<B, P1=(A+B)/2−I1, P2=B+I2, P3=P2=B+I2, P4=B+I1, therein, I1 and I2 represent positive values which could be determined according to a specific waveform.

7. The decoding method of audio data as claimed in claim 4, wherein A, P1, P2, P3, P4, and B are used to represent the audio signal values of the waveforms of the five continuous time slots, in a third kind of waveform, the audio signal values meet a first feature: A>B, P1=A+I1, P2=A+I2, P3=P2=A+I2, P4=P2=(A+B)/2+I1, therein, I1 and I2 represent positive values which could be determined according to a specific waveform.

8. An electronic device, comprising:

an audio extraction module to extract left channel audio signal values in a left channel and right channel audio signal values in a right channel from audio signals of a stereo audio source of an the electronic device;

a LPF module to filter the left channel audio signal values and the right channel audio signal values to remove noise signals;

an audio processing module to perform a mathematical operation on the left channel audio signal values and the right channel audio signal values to generate absolute values, and calculate difference values of the left and right channel audio signal values;

a detection module to determine a time slot which is formed by a plurality of first audio signal values corresponding to a plurality of first difference values among the difference values, wherein each of the first difference values exceeds a threshold value and a time length of the time slot exceeds a preset time;

a decoding module to respectively multiply the time slots with the left channel audio signal values and the right channel audio signal values to obtain $LM_{1\sim n}$ and $RM_{1\sim n}$, wherein $LM_{1\sim n}$ represents a left channel audio signal value multiplied by the time slots and $RM_{1\sim n}$ represents a right channel audio signal value multiplied by the time slots, and then making subtraction to obtain $DM_{1\sim n}$ ($DM_{1\sim n}=LM_{1\sim n}-RM_{1\sim n}$) find a U shaped pattern or an inverse U shaped pattern which meets proportionality from the waveform of $DM_{1\sim n}$; and decode the written symbol "0" or "1" according to the found U shaped pattern or inverse U shaped pattern.

9. The electronic device as claimed in claim 8, wherein the audio processing module is further configured to calculate a plurality of first enveloping values for each of the left channel audio signal values, calculate a plurality of second enveloping values for each of the right channel audio signal values; and calculate a plurality of enveloping difference values corresponding to the audio signal values on the basis of the first and second enveloping values.

10. The electronic device as claimed in claim 8, wherein the audio processing module is further configured to calculate the first and second enveloping values using a moving average method.

11. The electronic device as claimed in claim 8, wherein the digital copyright information is a binary number including a plurality of bits, each representing a symbol, wherein the decoding module is further configured to determine whether the waveforms of U shaped pattern meets proportionality by collecting audio signal values of the waveforms of five continuous time slots, and determining if the audio signal values meet certain features of kinds of waveforms of the U shaped pattern.

12. The electronic device as claimed in claim 11, wherein A, P1, P2, P3, P4, and B are used to represent the audio signal values of the waveforms of the five continuous time slots, in a first kind of waveform, the audio signal values meet a first feature: A=B, P1=(A+B)/2+I1, P2=(A+B)/2+I2, P3=P2=(A+B)/2+I2, P4=P2=(A+B)/2+I1, therein, I1 and I2 represent positive values which could be determined according to a specific waveform.

13. The electronic device as claimed in claim 11, wherein A, P1, P2, P3, P4, and B are used to represent the audio signal values of the waveforms of the five continuous time slots, in a second kind of waveform, the audio signal values meet a first feature: $A<B$, $P1=(A+B)/2-I1$, $P2=B+I2$, $P3=P2=B+I2$, $P4=B+I1$, therein, I1 and I2 represent positive values which could be determined according to a specific waveform.

14. The electronic device as claimed in claim 11, wherein A, P1, P2, P3, P4, and B are used to represent the audio signal values of the waveforms of the five continuous time slots, in a third kind of waveform, the audio signal values meet a first feature: $A>B$, $P1=A+I1$, $P2=A+I2$, $P3=P2=A+I2$, $P4=P2=(A+B)/2+I1$, therein, I1 and I2 represent positive values which could be determined according to a specific waveform.

15. The electronic device as claimed in claim 11, wherein the electronic device further comprises a storage module, for storing the left channel audio signal values and the right channel audio signal values retrieved by the audio extraction module.

* * * * *